US012557927B2

(12) United States Patent
Jang

(10) Patent No.: US 12,557,927 B2
(45) Date of Patent: Feb. 24, 2026

(54) MOTION PILLOW

(71) Applicant: TENMINDS CO., LTD., Seoul (KR)

(72) Inventor: Seung Woong Jang, Seoul (KR)

(73) Assignee: TENMINDS CO., LTD., Seoul (KR)

( * ) Notice: Subject to any disclaimer, the term of this patent is extended or adjusted under 35 U.S.C. 154(b) by 346 days.

(21) Appl. No.: 18/030,830

(22) PCT Filed: Oct. 7, 2021

(86) PCT No.: PCT/KR2021/013751
§ 371 (c)(1),
(2) Date: Apr. 7, 2023

(87) PCT Pub. No.: WO2022/075761
PCT Pub. Date: Apr. 14, 2022

(65) Prior Publication Data

US 2023/0371722 A1 Nov. 23, 2023

(30) Foreign Application Priority Data

Oct. 7, 2020 (KR) ..... 10-2020-0129620
Dec. 7, 2020 (KR) ..... 10-2020-0169653

(51) Int. Cl.
*A47G 9/10* (2006.01)

(52) U.S. Cl.
CPC .... *A47G 9/1027* (2013.01); *A47G 2009/1018* (2013.01)

(58) Field of Classification Search
CPC ..... A47G 9/10; A47G 9/1009; A47G 9/1027; A47G 9/1036; A47G 9/1045;
(Continued)

(56) References Cited

U.S. PATENT DOCUMENTS

2014/0310878 A1* 10/2014 Herrnsdorf ..... A61F 5/56 5/640
2015/0368465 A1* 12/2015 Ausmeier ..... B62J 1/26 428/76

(Continued)

FOREIGN PATENT DOCUMENTS

KR 10-2004-0101584 A 12/2004
KR 10-1511729 B1 4/2015

(Continued)

OTHER PUBLICATIONS

International Search Report for PCT/KR2021/013751 mailed on Feb. 8, 2022.

*Primary Examiner* — George Sun
(74) *Attorney, Agent, or Firm* — The PL Law Group, PLLC

(57) ABSTRACT

A motion pillow includes an air bag connected to an air pump through an air hose, an inner cover to wrap the air bag, an outer cover to wrap the inner cover at the outside of the inner cover, and a noise reduction device between the air pump and the air bag. The noise reduction device includes a housing, a first connector to protrude from one end of the housing, connected to the air pump, and having an inner diameter smaller than that of the housing, a second connector to protrude from the other end of the housing, connected to the air bag, and having an inner diameter smaller than that of the housing, a sound absorbing material filled in a partial space inside the housing, and a vibration-proof material filled in the remaining space inside the housing where the sound absorbing material is not filled.

11 Claims, 13 Drawing Sheets

(58) Field of Classification Search
CPC .. A47G 9/1054; A47G 9/1063; A47G 9/1072; A47G 9/1081; A47G 9/109; A47G 2009/1018
See application file for complete search history.

(56) References Cited

U.S. PATENT DOCUMENTS

| | | | | |
|---|---|---|---|---|
| 2016/0066716 | A1* | 3/2016 | Rao | A61B 5/6814 600/26 |
| 2016/0327113 | A1* | 11/2016 | Shelley | B32B 27/20 |
| 2018/0042408 | A1* | 2/2018 | Huang | A61B 5/6892 |
| 2024/0099485 | A1* | 3/2024 | Stojanovic | A47G 9/1036 |
| 2024/0374058 | A1* | 11/2024 | Han | A47G 9/1027 |

FOREIGN PATENT DOCUMENTS

| | | | |
|---|---|---|---|
| KR | 10-2017-0112943 | A | 10/2017 |
| KR | 10-2236337 | B1 | 4/2021 |
| KR | 10-2272919 | B1 | 7/2021 |

* cited by examiner

MOTION PILLOW

CROSS REFERENCE TO RELATED APPLICATIONS AND CLAIM OF PRIORITY

This application claims benefit under 35 U.S.C. 119(e), 120, 121, or 365(c), and is a National Stage Entry from International Application No. PCT/KR2021/013751, filed Oct. 7, 2021, which claims priority to the benefit of Korean Patent Application Nos. 10-2020-0129620 filed on Oct. 7, 2020, and 10-2020-0169653 filed on Dec. 7, 2020 in the Korean Intellectual Property Office the entire contents of which are incorporated herein by reference.

BACKGROUND

1. Technical Field

An embodiment of the present invention relates to a motion pillow.

2. Background Art

A motion pillow includes a pillow and a solution box. When the motion pillow detects snoring while a user sleeps on a pillow, the motion pillow injects air to an air bag (air bag provided at a head of the user among a plurality of air bags) embedded in a pillow through an air pump of a solution box to expand the pillow, thereby turning the head of the user.

A typical motion pillow is configured in such a manner that as an air hose connecting the air bag of the pillow and the solution box is connected through an upper center of the pillow, the air hose may pass through a separate through-hole formed in an upper center of a pillow cover. In this case, when a user replaces the pillow cover as necessary or according to a taste of the user, replacement of the pillow cover is extremely difficult.

Also, in case of the typical motion pillow, the user may not adjust a height of the pillow to a desired height of the user, and a noise (which is heard by the user when the user lies on the side, and an ear to the user touches the pillow) caused by a vibration of a pump when air is injected from the solution box to the air bag is generated.

SUMMARY

A disclosed embodiment provides a motion pillow that allows a pillow cover to be easily replaced.

A disclosed embodiment provides a motion pillow that easily adjusts a height of a pillow.

A disclosed embodiment provides a motion pillow capable of reducing a noise and a vibration.

A disclosed embodiment of the present invention provides a motion pillow including: an air bag which is connected to an air pump through an air hose and in which air supplied from the air hose is injected; an inner cover provided to wrap the air bag; an outer cover provided to wrap the inner cover at the outside of the inner cover; and a noise reduction device provided between the air pump and the air bag. Here, the noise reduction device includes: a housing of which the inside is hollow; a first connector provided to protrude from one end of the housing, connected to the air pump through the air hose, and having an inner diameter smaller than that of the housing; a second connector provided to protrude from the other end of the housing, connected to the air bag through the air hose, and having an inner diameter smaller than that of the housing; a sound absorbing material filled in a partial space inside the housing; and a vibration-proof material filled in the remaining space inside the housing, in which the sound absorbing material is not filled.

In an embodiment, the one end and the other end of the housing may have the same area and shape as each other, and the first connector and the second connector may vertically protrude from centers of the one end and the other end of the housing, respectively.

In an embodiment, the sound absorbing material may be provided at a central portion inside the housing, and the vibration-proof material may include: a first vibration-proof material provided between the first connector and the sound absorbing material inside the housing; and a second vibration-proof material provided between the sound absorbing material and the second connector inside the housing.

In an embodiment, each of the first vibration-proof material and the second vibration-proof material may include: an outer structure having a shape corresponding to an inner space of the housing; an inner structure provided in the outer structure; an outer piece provided to fill a space between the outer structure and the inner structure; and an inner piece provided to fill an inner space of the inner structure.

In an embodiment, the inner structure may include: a first inner structure spaced apart from the outer structure inside the outer structure and provided in a longitudinal direction of the housing; and second inner structures spaced by a predetermined gap from each other on an outer surface of the first inner structure and configured to connect the first inner structure and the outer structure.

In an embodiment, the outer piece may be filled in each of spaces divided by the second inner structure inside the outer structure, and each of the first vibration-proof material and the second vibration-proof material may further include at least one through-hole formed in a thickness direction of the outer piece.

In an embodiment, the inner piece may be filled in the inner space of the first inner structure, and each of the first vibration-proof material and the second vibration-proof material may further include at least one through-hole formed in a thickness direction of the inner piece.

In an embodiment, the housing may have a cross-section along a longitudinal direction of the housing and be distinguished into a first housing and a second housing based on the cross-section.

In an embodiment, the first housing and the second housing may be bonded to each other at the cross-section and sealed through taping performed on an outer surface of the housing.

In an embodiment, the inner cover may include a through-hole into which the air hose is inserted, and the motion pillow may include: a first pocket provided on the inner cover, provided at one side of the through-hole based on the through-hole based on the through-hole, and extending in one direction in a state in which the air hose is bent; and a second pocket provided on the inner cover, provided at the other side of the through-hole based on the through-hole, and extending in the other direction in the state in which the air hose is bent.

In an embodiment, in each of the first pocket and the second pocket, an upper end and a lower end may be connected to the inner cover, and both sides may be opened so that the air hose passes therethrough.

In an embodiment, the motion pillow may further include: a memory foam provided on the air bag inside the inner cover; and a height adjustment pad provided on at least one of the inside of the inner cover and a portion between the inner cover and the outer cover.

According to the disclosed embodiment, as the air hose connecting the solution box and the air bag of the pillow passes in the left and right directions instead of passing through the pillow cover (outer cover), the pillow cover may be easily replaced, and the air hose may be prevented from being bent.

Also, as the separate pad is provided, the user may adjust the height of the pillow to the desired height of the user to improve the convenience of the user.

Also, as the noise reduction device is provided between the air pump and the air bag, the noise and the vibration may not be transmitted to the air bag when the air is injected from the air pump to the air bag through the air hose, and accordingly, the user may have a deep sleep.

DETAILED DESCRIPTION

Figure 1:
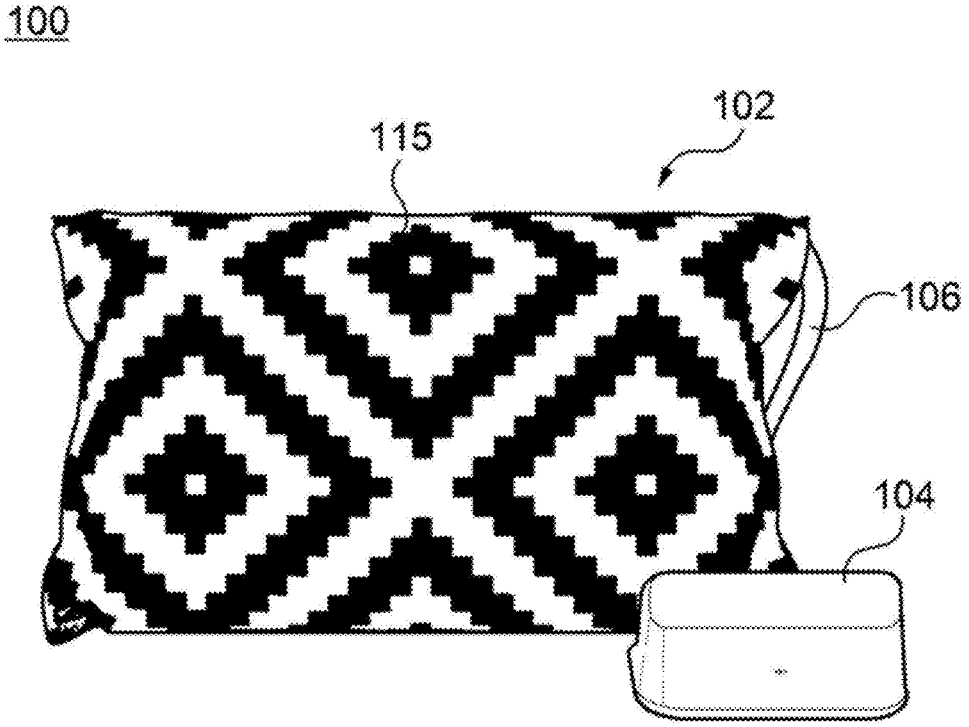
FIG. 1 is a view illustrating a motion pillow according to an embodiment of the present invention.

Hereinafter, preferred embodiments of the present invention will be described with reference to the accompanying drawings. Following detailed description will be provided for more general understanding on methods, devices, and/or systems in this specification. However, this is merely an example, and the embodiments of the present invention are not limited thereto.

Moreover, detailed descriptions related to well-known functions or configurations will be ruled out in order not to unnecessarily obscure subject matters of the present invention. Also, terms used in this specification are terms defined in consideration of functions according to embodiments, and thus the terms may be changed according to the intension or usage of a user or operator. Therefore, the terms should be defined on the basis of the overall contents of this specification. It will be understood that although the terms are used herein to describe various embodiments of the present inventions and should the embodiments not be limited by these terms. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

Spatially relative terms, such as "below", "lower", "above", "upper" and the like, may be used herein for ease of description to describe an element and/or a feature's relationship to another element(s) and/or feature(s) as illustrated in the figures. It will be understood that the spatially relative terms are intended to encompass different orientations of the device in use or operation in addition to the orientation depicted in the drawings.

It will be understood that although the terms of first and second are used herein to describe various elements, these elements should not be limited by these terms. The terms are only used to distinguish one component from other components. For example, a first element referred to as a first element in an embodiment can be referred to as a second element in another embodiment.

Figure 2:
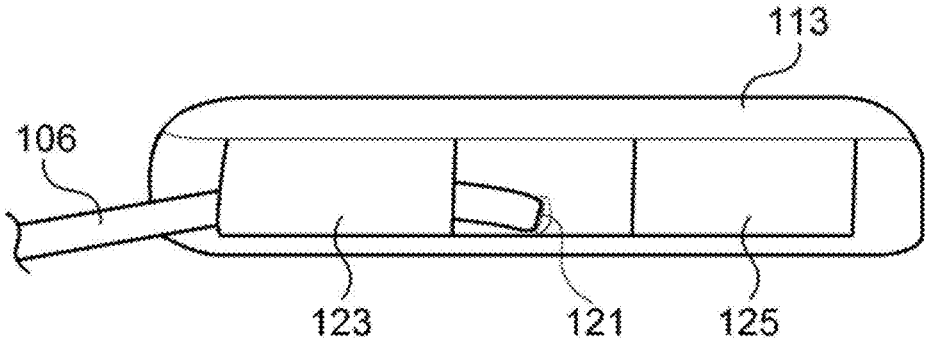
FIG. 2 is a view illustrating a state in which an air hose is connected to an inner cover according to an embodiment of the present invention.
Figure 3:
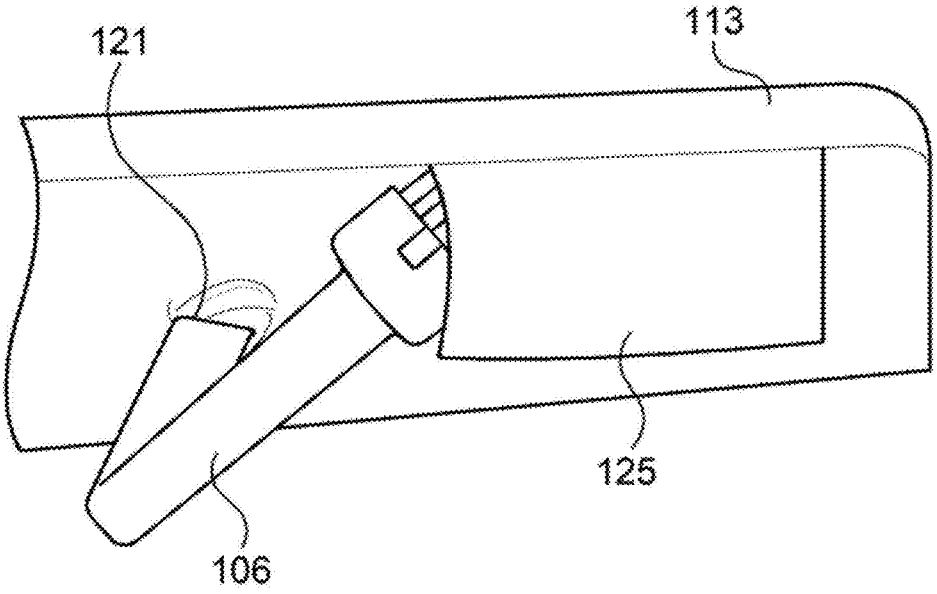
FIG. 3 is a view illustrating a state in which the air hose is inserted to a second pocket in the inner cover of a pillow according to an embodiment of the present invention.
Figure 4:
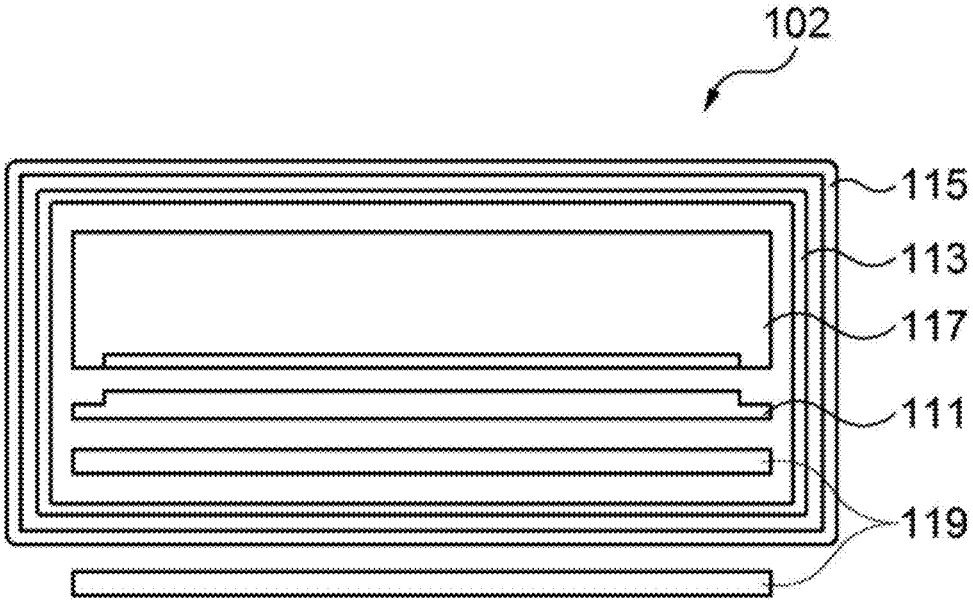
FIG. 4 is a schematic view illustrating a structure of a pillow in the motion pillow according to an embodiment of the present invention.
Figure 5:
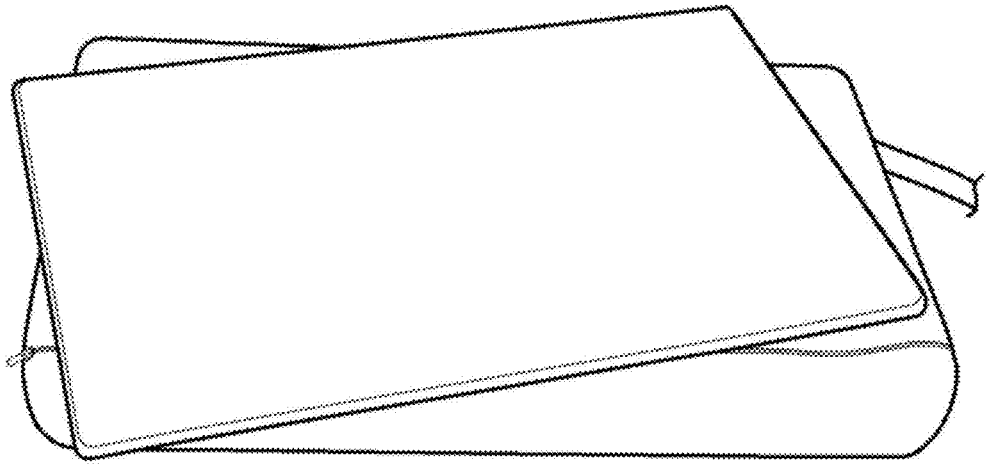
FIG. 5 is a view illustrating the inner cover and a height adjustment pad in the motion pillow according to an embodiment of the present invention.

FIG. 1 is a view illustrating a motion pillow according to an embodiment of the present invention, FIG. 2 is a view illustrating a state in which an air hose is connected to an inner cover of a pillow according to an embodiment of the present invention, FIG. 3 is a view illustrating a state in which the air hose is inserted to a second pocket from the inner cover of the pillow according to an embodiment of the present invention, FIG. 4 is a schematic view illustrating a structure of the pillow in the motion pillow according to an embodiment of the present invention, and FIG. 5 is a view illustrating the inner cover and a high adjustment pad in the motion pillow according to an embodiment of the present invention.

Referring to FIGS. 1 to 5, a motion pillow 100 may include a pillow 102 and a solution box 104. The pillow 102 may be connected to the solution box 104 through an air hose 106.

Here, the pillow 102 may include a plurality of air bags 111, an inner cover 113, and an outer cover 115. Also, in embodiments, the pillow 102 may further include at least one of a memory foam 117 and a height adjustment pad 119.

The plurality of air bags 111 may be connected to the air pump provided in the solution box 104 through the air hose 106. The plurality of air bags 111 may be inflated by air injected from the air pump and adjusted in height.

In an exemplary embodiment, the plurality of air bags 111 may be arranged in parallel in a horizontal direction in the pillow 102. When a user snores, as air is injected into the air bag 111 from the air pump of the solution box 104 to inflate the air bag 111, a position of a head of the user may be changed to prevent snoring. Here, the snoring of the user may be detected by a sensor provided in the solution box 104. The inflated air bag 111 may decrease in height as the air therein is discharged naturally after a predetermined time elapses.

The inner cover 113 may be provided to wrap the air bag 111, the memory foam 117, and the height adjustment pad 119, which are provided inside the pillow 102. For example, although the inner cover 113 may integrally wrap the air bag 111, the memory foam 117, and the height adjustment pad 119, the present invention is not limited thereto.

The inner cover 113 may have a through-hole 121 at one side surface so that the air hose 106 is inserted thereto. Also, a first pocket 123 and a second pocket 125 may be provided on the inner cover 113 so that the air hose 106 extends in a left or right direction of the outer cover 115 in a state in which the air hose 106 is bent. The first pocket 123 and the second pocket 125 may be provided at both sides of the through-hole 121 based on the through-hole 121.

In an exemplary embodiment, the through-hole 121 may be defined in a center of one side surface of the inner cover 113. The first pocket 123 may be provided at the left side of the through hole 121, and the second pocket 125 may be provided at the right side of the through-hole 121.

Upper and lower ends of each of the first pocket 123 and the second pocket 125 are connected to the inner cover 113, and both sides of each thereof may be opened so that the air hose 106 passes therethrough. Here, the air hose 106 may pass through the first pocket 123 and extend to the left or pass through the second pocket 125 and extend to the right.

The outer cover 115 may be provided to wrap the inner cover 113. That is, the outer cover 115 may correspond to the externally visible outer surface of the pillow 102 and be provided to wrap the inner cover 113 at the outside of the inner cover 113.

In the disclosed embodiment, an opening may be provided in one or more of the left and right sides of the outer cover 115 so that the air hose 106 passes therethrough. That is, as the through-hole 121 is formed in the inner cover 113, and the first pocket 123 and the second pocket 125 are provided at both sides based on the through-hole 121, the air hose 106 may pass in a left or right direction even without passing through a center of the outer cover 115, and the outer cover 115 may be easily replaced.

Also, an opening may be formed in one or more of the left and right sides of the outer cover 115 instead of forming an opening for the air hose 106 to pass therethrough at the center of the outer cover 115, and thus, a shape of the outer cover 115 may be freely designed.

The memory foam 117 may be provided above the plurality of airbags 111 inside the inner cover 113. In an embodiment, the memory form 117 may have a thickness greater than that of the plurality of airbags 111.

The height adjustment pad 119 may be provided below the plurality of airbags 111 inside the inner cover 113. As described above, the height adjustment pad 119 provided inside the inner cover 113 may be referred to as an inner height adjustment pad.

Also, the height adjustment pad 119 may be provided between the inner cover 113 and the outer cover 115. As described above, the height adjustment pad 119 provided between the inner cover 113 and the outer cover 115 may be referred to as an outer height adjustment pad.

In an exemplary embodiment, the motion pillow 102 may include at least one of the inner height adjustment pad and the outer height adjustment pad. In the disclosed embodiment, as the separate height adjustment pad 119 is provided, a height of the pillow 102 may be freely adjusted to a desired height of the user.

When the user of the pillow 102 snores, the solution box 104 may serve to inject air into the air bag 111 through the air hose 106 by detecting the snoring. To this end, the solution box 104 may include a snoring detecting sensor. Also, the solution box 104 may include an air pump and a motor for operating the air pump.

Figure 6:
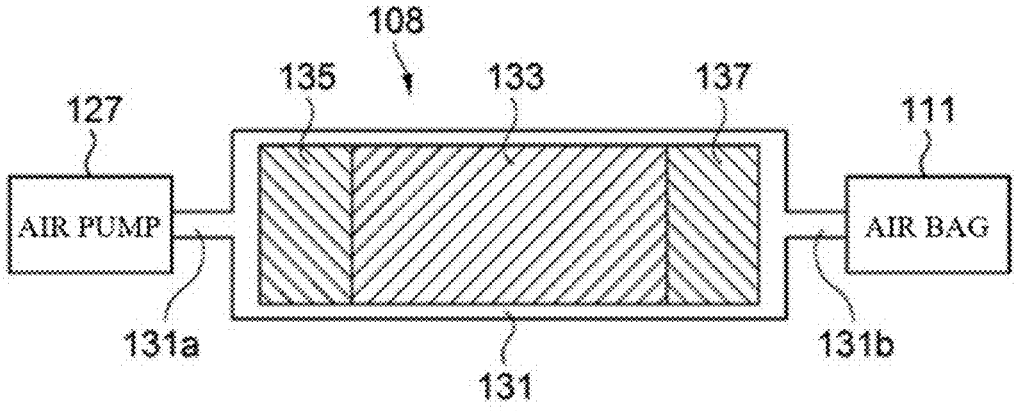
FIG. 6 is a schematic view illustrating a noise reduction device according to an embodiment of the present invention.

The motion pillow 100 may further include a noise reduction device capable of reducing a noise caused by a vibration generated when air is injected into the air bag 11. FIG. 6 is a schematic view illustrating the noise reduction device according to an embodiment of the present invention, and FIG. 7 is a cross-sectional view illustrating a housing in the noise reduction device according to an embodiment of the present invention.

Figure 7:
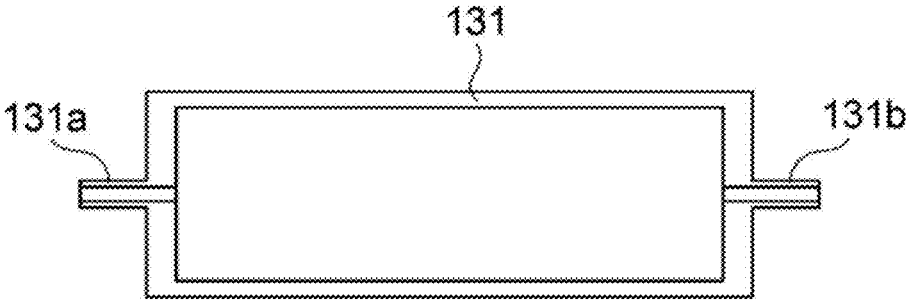
FIG. 7 is a cross-sectional view illustrating a housing in the noise reduction device according to an embodiment of the present invention.

Referring to FIGS. 6 and 7, a noise reduction device 108 may be provided between the air pump 127 and the air bag 111. The air pump 127 may be provided in the solution box 104. The noise reduction device 108 may include a housing 131, a sound absorbing material 133, a first vibration-proof material 135, and a second vibration-proof material 137.

The housing 131 may constitute an appearance of the noise reduction device 108. Although the housing 131 may have a hollow cylindrical shape, the present invention is not limited to the shape of the housing. A first connector 131*a* may be provided at one side of the housing 131. The first connector 131*a* may be connected to the air pump 127 through the air hose 106. Here, the housing 131 may be connected to the air pump 127 through the first connector 131*a*.

A second connector 131*b* may be provided at the other side of the housing 131. The second connector 131*a* may be connected to the air pump 111 through the air hose 106. Here, the housing 131 may be connected to the air bag 111 through the second connector 131*b*.

Here, the first connector 131*a* and the second connector 131*b* may be provided symmetrically with respect to the housing 131. Each of the first connector 131*a* and the second connector 131*b* may have a hollow shape through which air passes.

Each of the first connector 131*a* and the second connector 131*b* may have an inner diameter less than that of the housing 131. The first connector 131*a* and the second connector 131*b* may vertically protrude from one end and the other end of the housing 131, respectively. The one end and the other end of the housing 131 may have the same area and shape as each other.

Here, the first connector 131*a* and the second connector 131*b* may protrude from centers of the one end and the other end of the housing 131, respectively. In this case, air supplied through the air hose 106 may be injected into the housing 131 and then discharged uniformly from the housing 131.

In an exemplary embodiment, although the first connector 131*a* and the second connector 131*b* are integrated with the housing 131, the present invention is not limited thereto. For example, the first connector 131*a* and a half of the housing 131 (i.e., a portion adjacent to the first connector 131*a* based on the center of the housing 131) may be integrated with each other, and the second connector 131*b* and the rest half (i.e., a portion adjacent to the second connector 131*b* based on the center of the housing 131) may be integrated with each other. In this case, the two portions of the housing 131 may be bonded to each other by an adhesive agent or an adhesive tape.

The sound absorbing material 133 may be filled in the housing 131. In an exemplary embodiment, the sound absorbing material 133 may be provided at a central portion inside the housing 131.

The sound absorbing material 133 may serve to reduce a noise caused by the air pump 127 when air passes through the housing 131. For example, although the sound absorbing material 133 may include polyester or a glass fiber having multiple pores, the present invention is not limited thereto. For example, the sound absorbing material 133 may include various materials capable of absorbing a noise.

The first vibration-proof material 135 may be provided inside the housing 131. In an exemplary embodiment, the first vibration-proof material 135 may be embedded between the first connector 131*a* and the sound absorbing material 133 inside the housing 131.

The second vibration-proof material 137 may be provided inside the housing 131. In an exemplary embodiment, the second vibration-proof material 135 may be embedded between the second connector 131*a* and the sound absorbing material 133 inside the housing 131.

The first vibration-proof material 135 and the second vibration-proof material 137 may serve to reduce a vibration caused by the air pump 127 when air passes through the housing 131. For example, although each of the first vibration-proof material 135 and the second vibration-proof material 137 may include natural rubber, styrene-butadiene rubber, or butadiene rubber, the present invention is not limited thereto. For example, each of the first vibration-proof material 135 and the second vibration-proof material 137 may include various materials capable of reducing a vibration in addition thereto.

Each of the first vibration-proof material 135 and the second vibration-proof material 137 may have a thickness (i.e., a length in a longitudinal direction of the housing 131) less than that of the sound absorbing material 133. In an exemplary embodiment, although each of the first vibration-proof material 135 and the second vibration-proof material 137 may have a thickness that is 0.1 times to 0.3 times of a thickness of the sound absorbing material 140, the present invention is not limited thereto.

Figure 8:
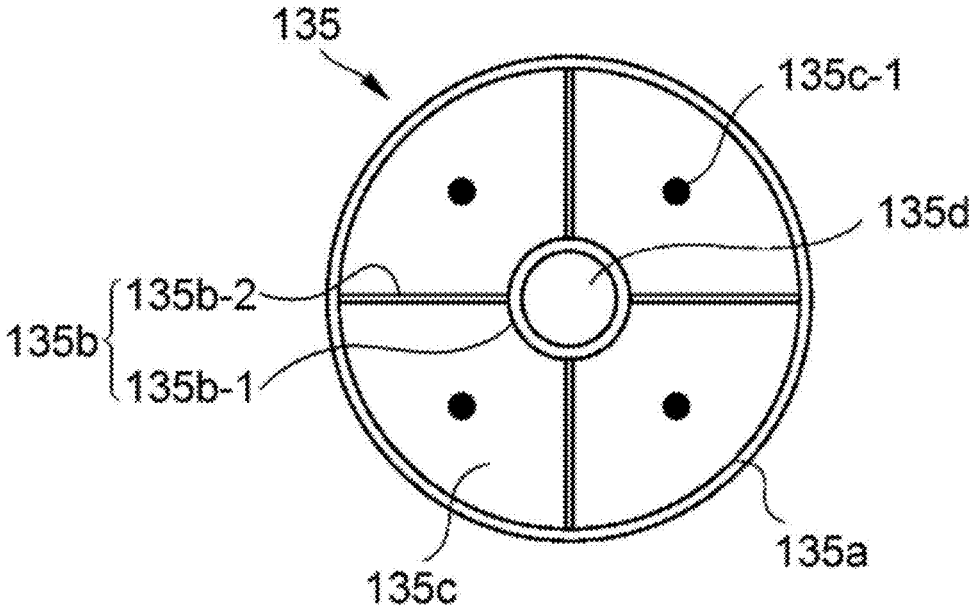
FIG. 8 is a cross-sectional view illustrating a first vibration-proof material in the noise reduction device according to an embodiment of the present invention.

FIG. 8 is a cross-sectional view illustrating the first vibration-proof material 135 in the noise reduction device according to an embodiment of the present invention. Here, the second vibration-proof material 137 may have a cross-sectional shape that is the same as or similar to that of the first vibration-proof material 135. Referring to FIG. 8, the first vibration-proof material 135 may include an outer structure 135*a*, an inner structure 135*b*, an outer piece 135*c*, and an inner piece 135*d*.

The outer structure 135*a* may constitute an appearance of the first vibration-proof material 135. The outer structure 135*a* may have a shape corresponding to an inner space of the housing 131. The outer structure 135*a* may have a hollow shape.

The inner structure 135*b* may include a first inner structure 135*b*-1 and second inner structures 135*b*-2. The first inner structure 135*b*-1 may be spaced apart from the outer structure 135*a* in the outer structure 135*a*. The first inner structure 135*b*-1 may have a ring shape at a central portion of the outer structure 135*a*. The first inner structure 135*b*-1 may be provided in a thickness direction (i.e., the longitudinal direction of the housing 131) of the first vibration-proof material 135.

The second inner structures 135*b*-2 may be spaced by a predetermined gap from each other on an outer surface of the first inner structure 135*b*-1 to connect the first inner structure 135*b*-1 and the outer structure 135*a*. Although the second inner structures 135*b*-2 are spaced by 90° on the outer surface of the first inner structure 135*b*-1 in FIG. 8, the present invention is not limited thereto. For example, the second inner structures 135*b*-2 may be spaced by 60° or 120° as necessary. The second inner structures 135*b*-2 may serve to divide a space between the first inner structure 135*b*-1 and the outer structure 135*a* into a plurality of spaces.

The outer piece 135*c* may be filled in each of the spaces divided by the second inner structure 135*b*-2 in the outer structure 135*a*. The outer piece 135*c* may be made of a material capable of reducing a vibration.

The inner piece 135*d* may be filled in the inner space of the first inner structure 135*b*-1. The inner piece 135*d* may be made of a material capable of reducing a vibration. Although the inner piece 135*d* may be made of the same material as that of the outer piece 135*c*, the present invention is not limited thereto. Here, the outer piece 135*c* and the inner piece 135*d* may be isolated from each other by the first inner structure 135*b*-1 and the second inner structure 135*b*-2.

A through-hole 135*c*-1 may be formed in the outer piece 135*c* in a thickness direction of the outer piece 135*c*. The through-hole 135*c*-1 may be formed in a central portion of the outer piece 135*c*.

Figure 9:
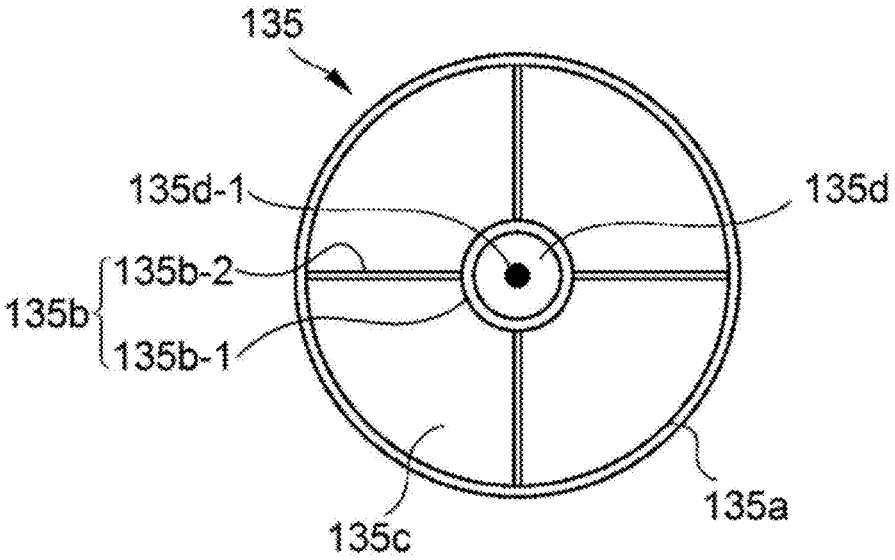
FIG. 9 is a view illustrating a state in which a through-hole is formed in an inner piece in the noise reduction device according to an embodiment of the present invention.

However, the present invention is not limited thereto. For example, a through-hole 135*d*-1 may be defined in the inner piece 135*d* as illustrated in FIG. 9. The through-hole 135*d*-1 may be provided along a thickness direction of the inner piece 135*d*. Also, the through-hole 135*d*-1 may be provided at a central portion of the inner piece 135*d*. Here, each of the through-holes 135*c*-1 and 135*d*-1 may have an inner diameter less than that of each of the first connector 131*a* and the second connector 131*b*.

As described above, as the sound absorbing material 133 through which air passes is embedded inside the housing 131, and the first vibration-proof material 135 and the second vibration-proof material 137 each having the through-holes 135*c*-1 and 135*d*-1 are provided at both sides of the sound absorbing material 133, air may easily pass from the air pump 127 to the air bag 111, and also the noise and the vibration caused by the air pump 127 may be prevented.

Figure 10:
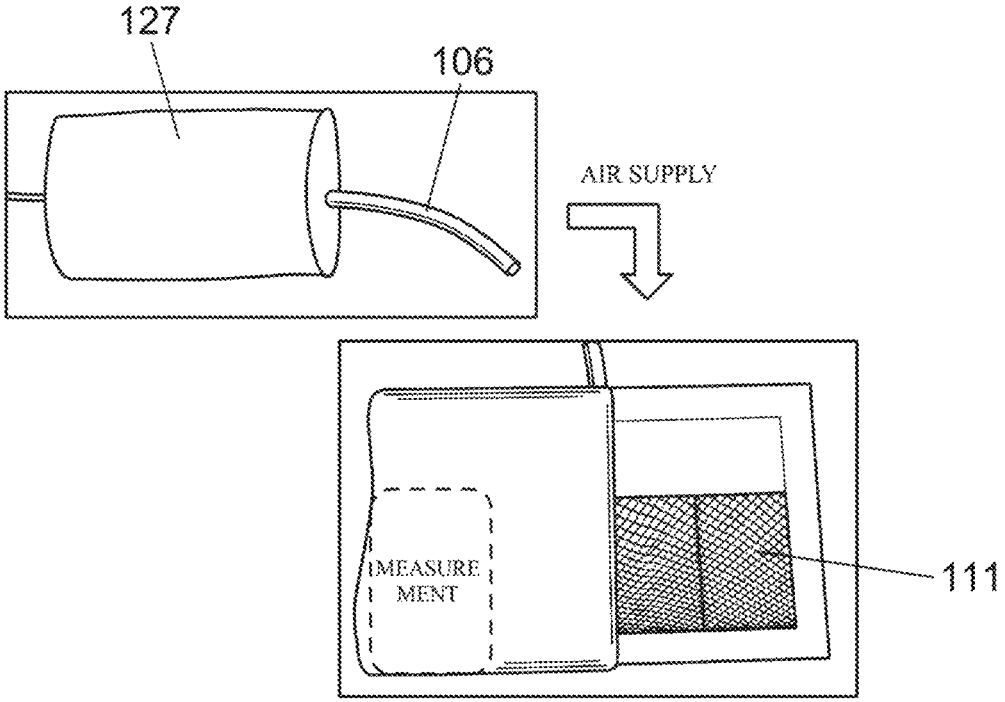
FIGS. 10 and 11 are views showing a noise experiment result in case that the noise reduction device is not provided when air is supplied from an air pump to an air bag.
Figure 11:
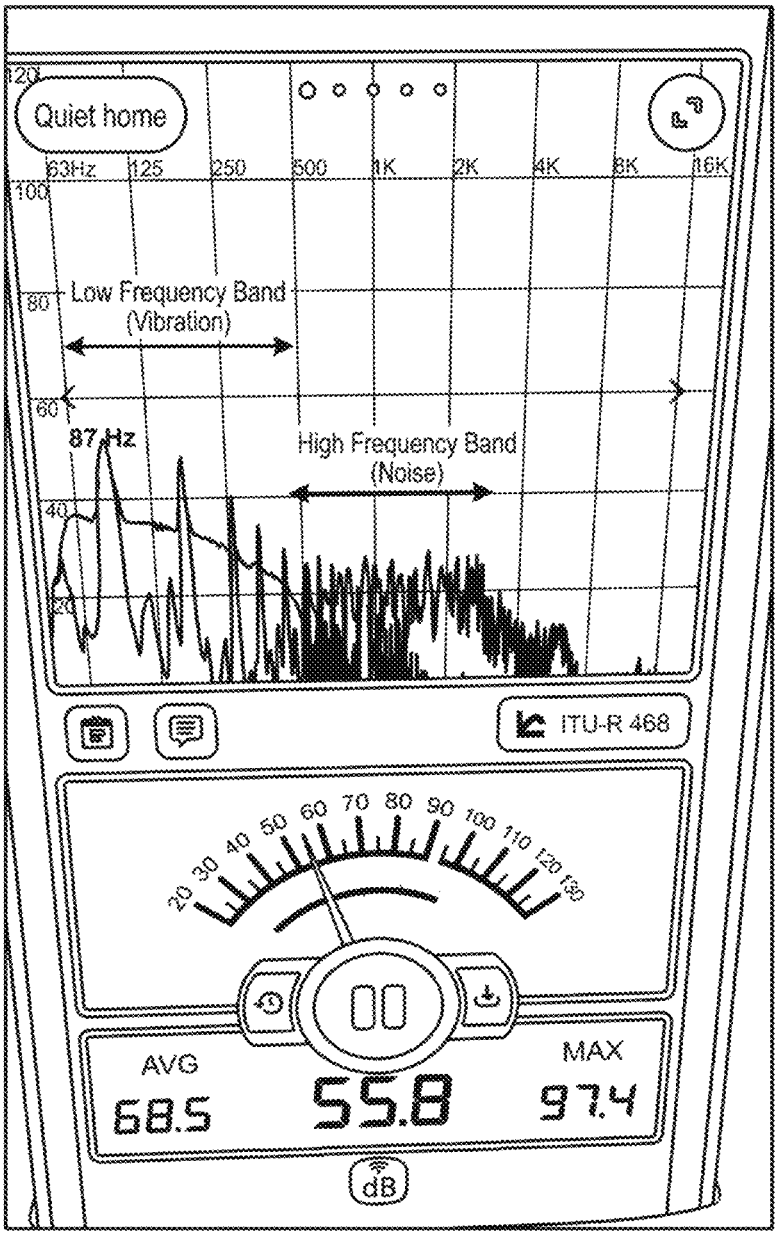

FIGS. 10 and 11 are views showing a noise experiment result when the noise reduction device 108 is not provided when air is supplied from the air pump 127 to the air bag 111. Referring to FIGS. 10 and 11, when the noise reduction device 108 is not provided between the air pump 127 and the air bag 111, a vibration is measured in a low-frequency band and a noise (55.8 dB) is measured in a high-frequency band. Here, the vibration in the low-frequency band is generated from the air pump 127, and the noise in the high-frequency band is generated from a motor (not shown).

Figure 12:
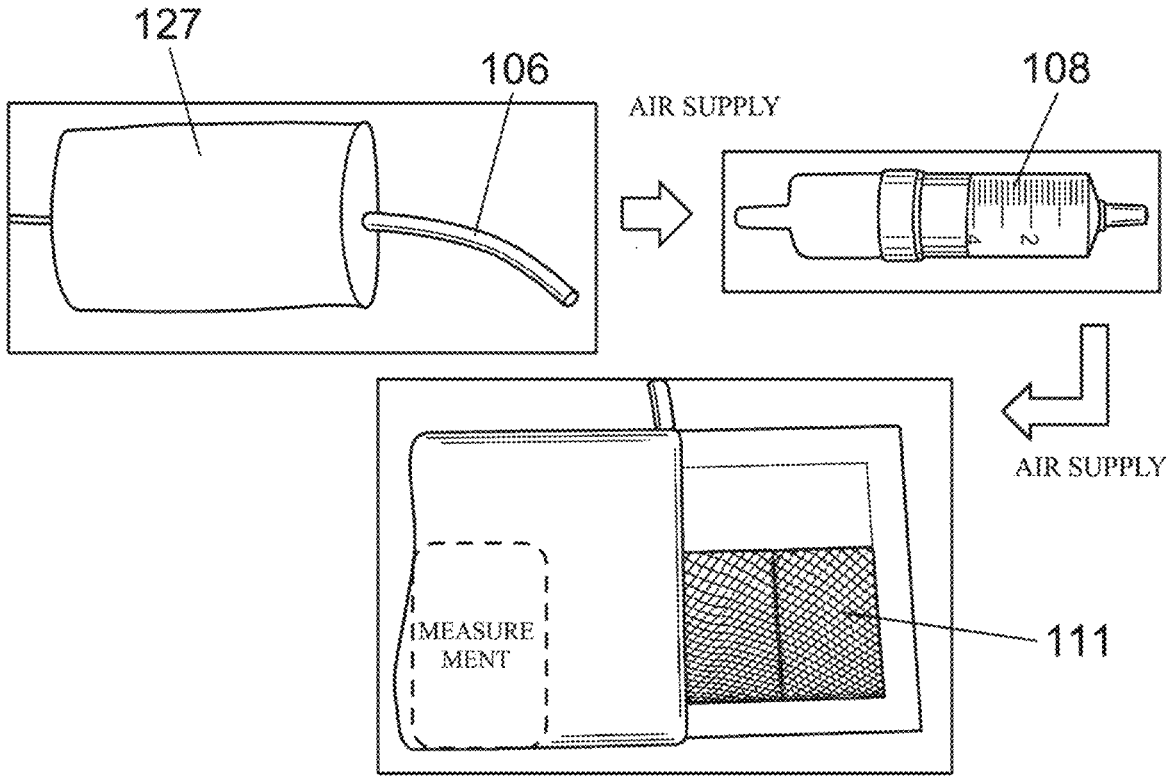
FIGS. 12 and 13 are views showing a noise experiment result in case that air is supplied from an air pump to an air bag through the noise reduction device.
Figure 13:
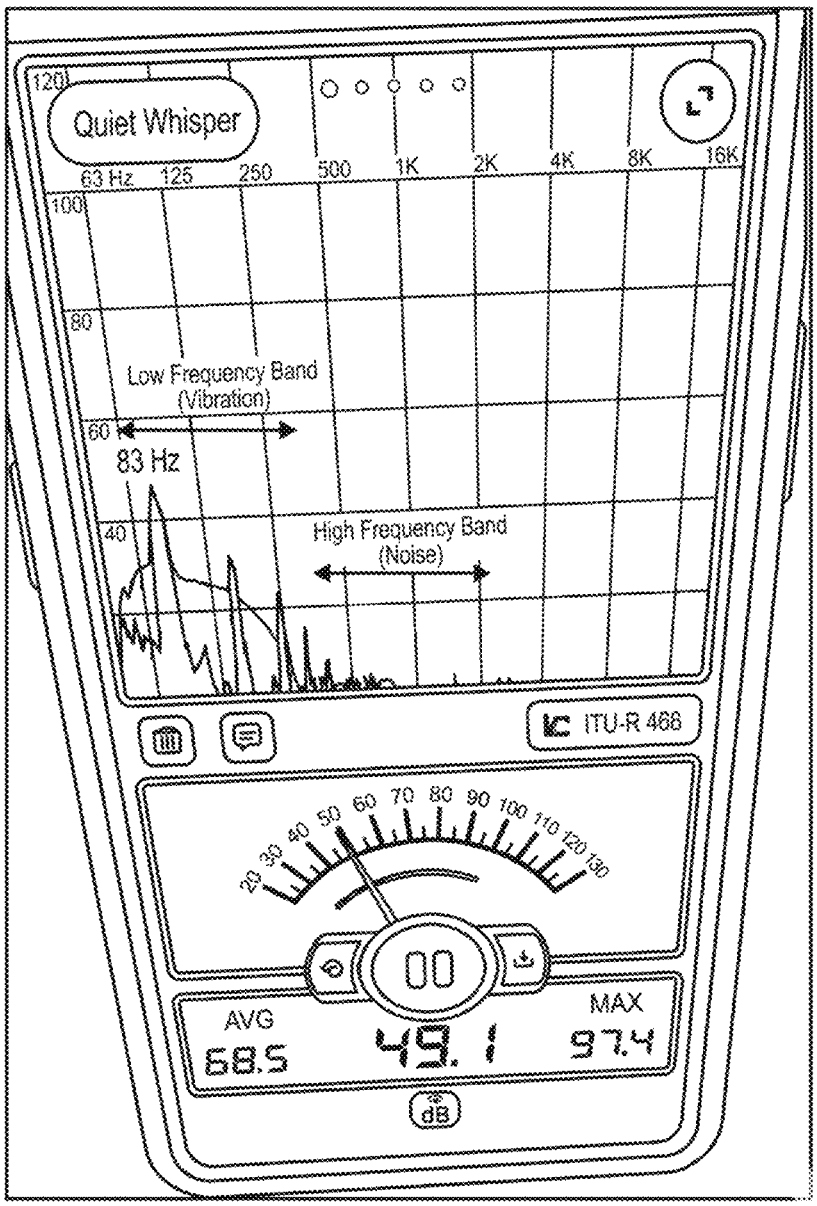

FIGS. 12 and 13 are views showing a noise experiment result when air is supplied from the air pump 127 to the air bag 111 through the noise reduction device 108 according to an embodiment of the present invention. Here, the noise reduction device 108 is measured in a state in which only the sound absorbing material 133 is filled in the housing 131 without the first vibration-proof material 135 and the second vibration-proof material 137.

Referring to FIGS. 12 and 13, it may be seen that a noise in a high-frequency band is 49.1 dB that is remarkably reduced from that of FIGS. 10 and 11. However, since the first vibration-proof material 135 and the second vibration-proof material 137 are not filled in the noise reduction device 108, it may be seen that a small amount of vibrations in the low-frequency band is remained.

Figure 14:
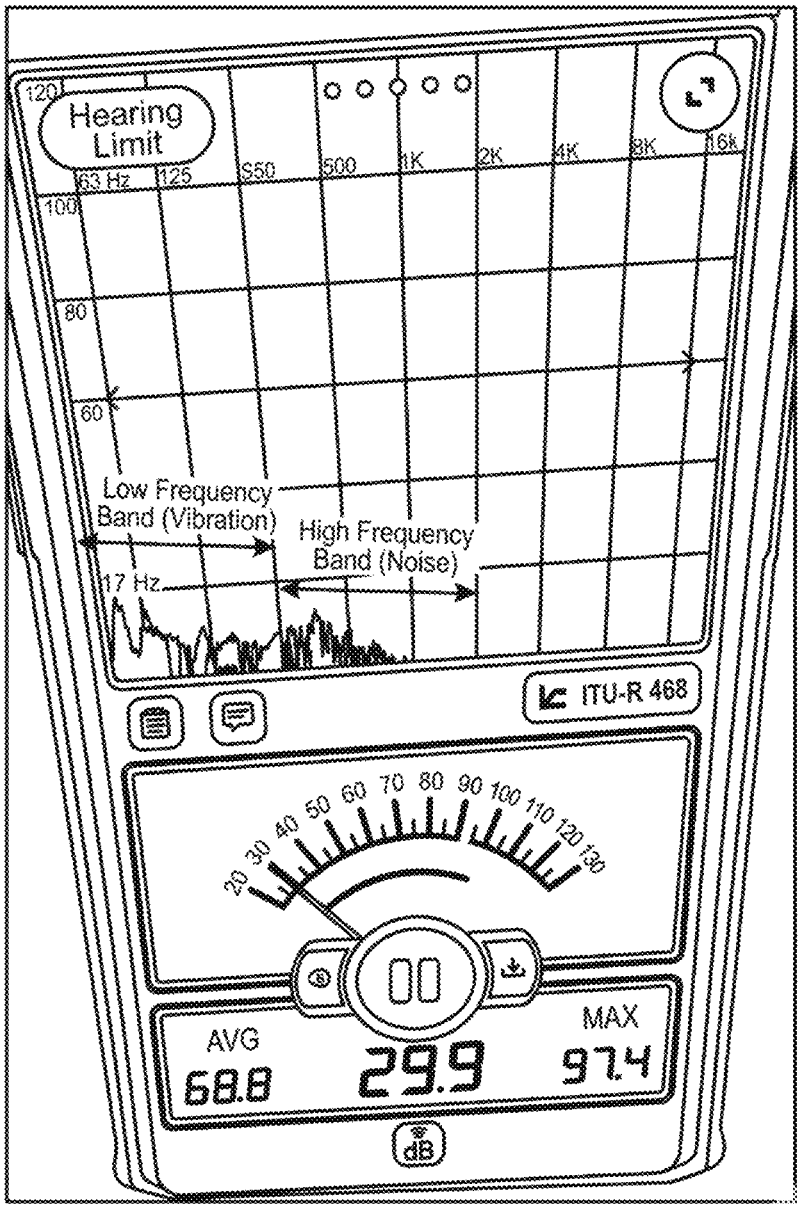
FIG. 14 is a view showing a noise experiment result in case that a sound absorbing material is provided at an inner center of the housing, a first vibration-proof material and a second vibration-proof material are provided at both sides of the sound absorbing material, respectively, and a through-hole is formed in an outer piece in the noise reduction device.

FIG. 14 is a view showing a noise experiment result when the sound absorbing material 133 is provided at an inner center of the housing 131, the first vibration-proof material 135 and the second vibration-proof material 137 are provided at both sides of the sound absorbing material 133, and the through-hole 135*c*-1 is formed in the outer piece 135*c* inside the noise reduction device 108 as illustrated in FIG. 8.

Referring to FIG. 14, it may be seen that the noise in the high-frequency ban is further reduced to 29.9 dB, and the vibration in the low-frequency band is also reduced.

Figure 15:
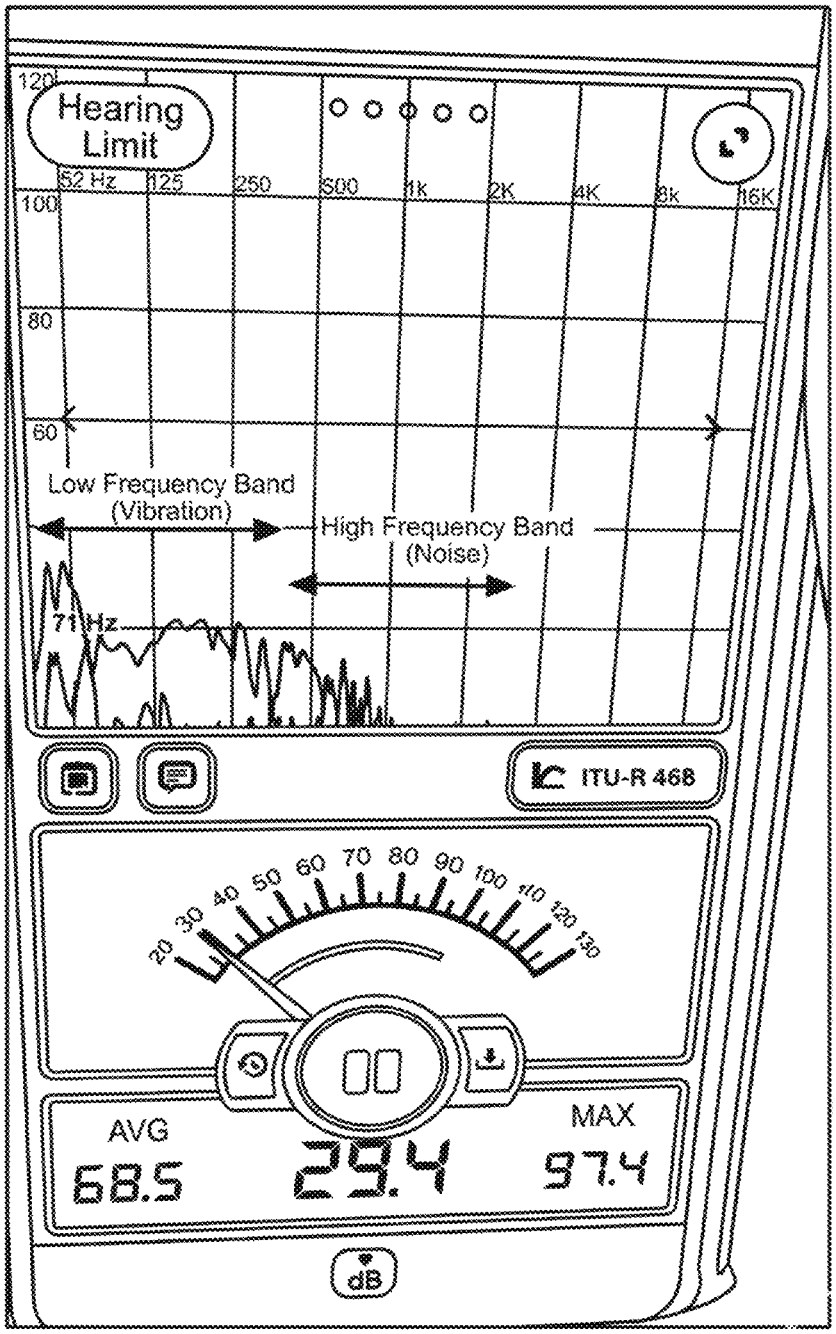
FIG. 15 is a view showing a noise experiment result in case that the sound absorbing material is provided at the inner center of the housing, the first vibration-proof material and the second vibration-proof material are provided at the both sides of the sound absorbing material, respectively, and a through-hole is formed in an inner piece in the noise reduction device.

Also, FIG. 15 is a view showing a noise experiment result when the sound absorbing material 133 is provided at an inner center of the housing 131, the first vibration-proof material 135 and the second vibration-proof material 137 are provided at the both sides of the sound absorbing material 133, and the through-hole 135*d*-1 is formed in the inner piece 135*d* in the noise reduction device 108 as illustrated in FIG. 9.

Referring to FIG. 15, it may be seen that the noise in the high-frequency band is further reduced to 29.4 dB, and the vibration in the low-frequency band is also reduced.

Figure 16:
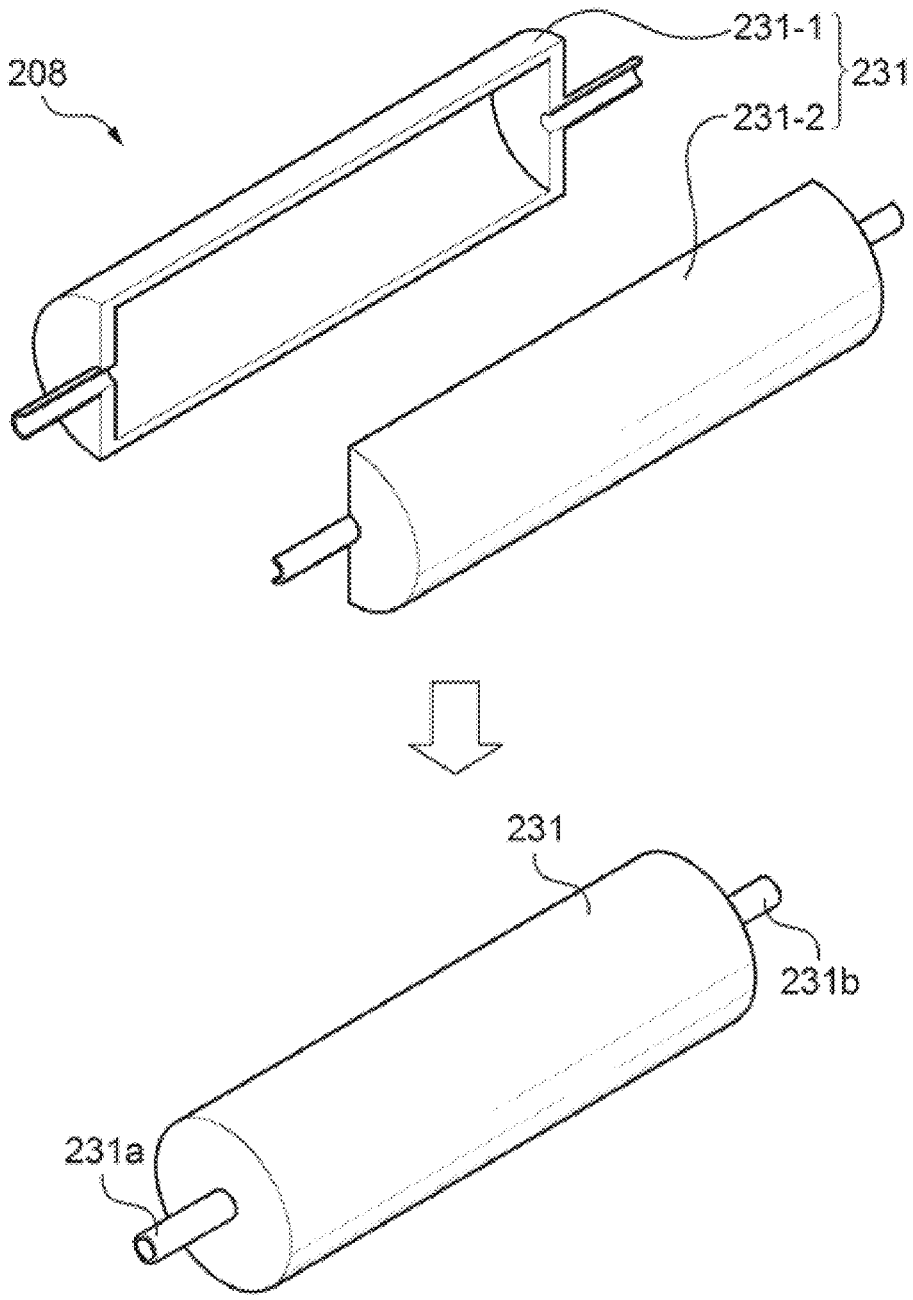
FIG. 16 is a view illustrating a noise reduction device according to another embodiment of the present invention.

FIG. 16 is a view illustrating a noise reduction device 208 according to another embodiment of the present invention. Here, a housing 231 of the noise reduction device 208 may include a first housing 231-1 and a second housing 231-2. That is, the housing 231 may have a cross-section in a longitudinal direction thereof, and the first housing 231-1 and the second housing 231-2 may be distinguished based on the cross-section. Here, although the cross-section may be formed at a center based on the longitudinal direction of the housing 231, the present invention is not limited thereto.

The first housing 231-1 and the second housing 231-2 may be bonded to each other at the cross-section. The first housing 231-1 and the second housing 231-2 may be bonded to each other, and then taping may be performed on an outer surface of the housing 231.

Here, reason of distinguishing the housing 231 into the first housing 231-1 and the second housing 231-2 based on the cross-section is to easily insert the sound absorbing material 233 and the vibration-proof material 233 into the housing 231. That is, as the housing 231 into the first housing 231-1 and the second housing 231-2 are distinguished, the sound absorbing material 233 and the vibration-proof material 233 may be embedded into the housing 231 with various shapes and arrangements.

Figure 17:
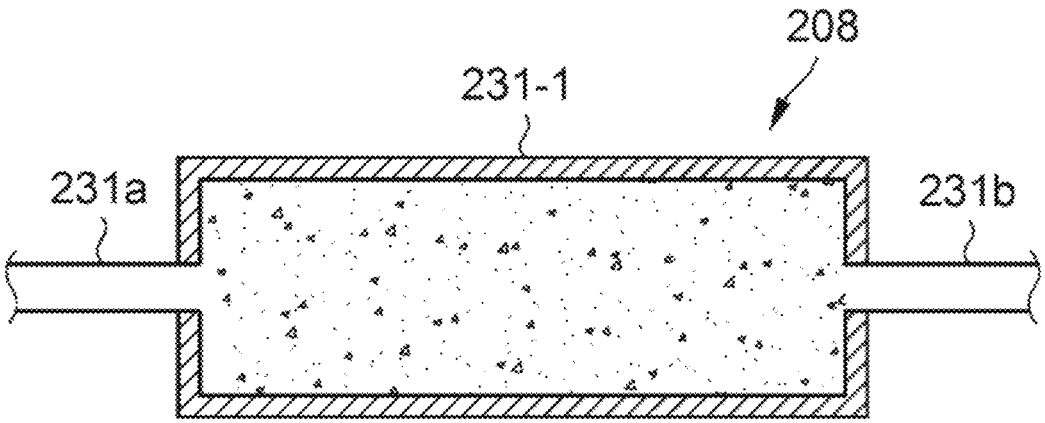
FIG. 17 is a view illustrating a state in which a sound absorbing material is filled in a first housing in a noise reduction device according to another embodiment of the present invention.
Figure 18:
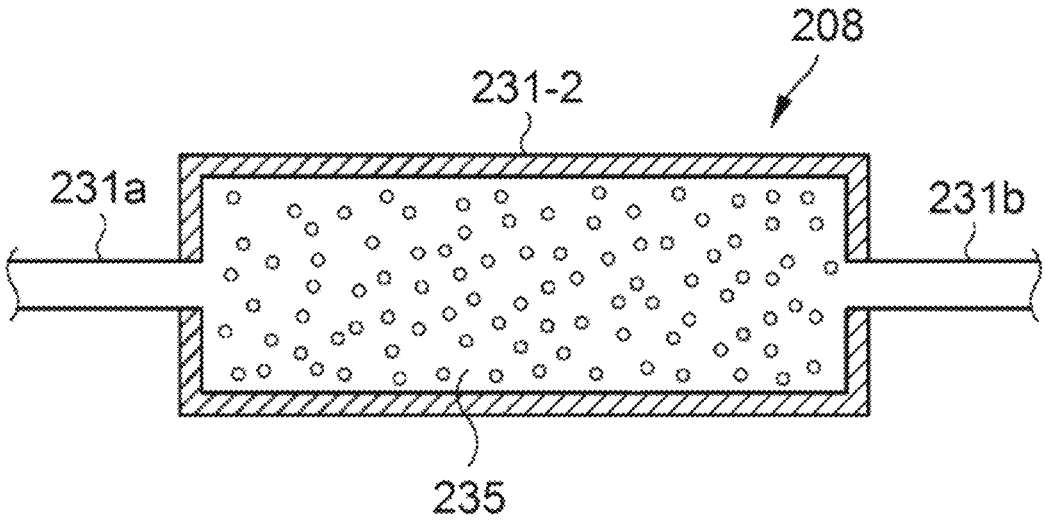
FIG. 18 is a view illustrating a state in which a vibration-proof material is filled in a second housing in the noise reduction device according to another embodiment of the present invention.

FIG. 17 is a view illustrating a state in which the sound absorbing material 233 is filled inside the first housing 231-1 in the noise reduction device 208 according to another embodiment of the present invention, and FIG. 18 is a view illustrating a state in which the vibration-proof material 235 is filled inside the second housing 231-2 in the noise reduction device 208 according to another embodiment of the present invention. However, the present invention is not limited thereto. For example, the sound absorbing material 233 may be provided at an inner center of the housing 231, and the vibration-proof material 235 may be provided at both sides of the sound absorbing material 233. Also, the sound absorbing material 233 or the vibration-proof material 235 may be embedded in the entire inside of the housing 231, or at least one of the sound absorbing material 233 and the vibration-proof material 235 may be filled into the housing 231 with various shapes and arrangements.

As described above, as the housing is distinguished into the first housing 231-1 and the second housing 231-2 based on the cross-section, at least one of the sound absorbing material 233 and the vibration-proof material 235 are filled therein, the first housing 231-1 and the second housing 231-2 are bonded to each other at the cross-section, and then taping is performed on the outer surface of the housing 231, the sound absorbing material 233 and the vibration-proof material 235 may be easily filled into the housing 231, and assembly convenience of the housing may be improved.

Although the noise reduction devices 108 and 208 are applied to the motion pillow in this specification, the present invention is not limited thereto. For example, the noise reduction devices 108 and 208 may be applied to various fields that require noise reduction.

Although the embodiments of the present invention have been described, it is understood that the present invention should not be limited to these embodiments but various changes and modifications can be made by one ordinary skilled in the art within the spirit and scope of the present invention as hereinafter claimed. Therefore, the scope of the present invention is defined not by the detailed description of the invention but by the appended claims, and all differences within the scope will be construed as being included in the present disclosure.

What is claimed is:

1. A motion pillow comprising:

an air bag which is connected to an air pump through an air hose and in which air supplied from the air hose is injected;

an inner cover provided to wrap the air bag;

an outer cover provided to wrap the inner cover at the outside of the inner cover; and a noise reduction device provided between the air pump and the air bag, wherein the noise reduction device comprises:

a housing of which the inside is hollow;

a first connector provided to protrude from one end of the housing, connected to the air pump through the air hose, and having an inner diameter smaller than that of the housing;

a second connector provided to protrude from the other end of the housing, connected to the air bag through the air hose, and having an inner diameter smaller than that of the housing;

a sound absorbing material filled in a partial space inside the housing; and a vibration-proof material filled in the remaining space inside the housing, in which the sound absorbing material is not filled, wherein the sound absorbing material is provided at a central portion inside the housing, and the vibration-proof material comprises:

a first vibration-proof material provided between the first connector and the sound absorbing material inside the housing; and a second vibration-proof material provided between the sound absorbing material and the second connector inside the housing.

2. The motion pillow of claim 1, wherein the one end and the other end of the housing have the same area and shape as each other, and the first connector and the second connector vertically protrude from centers of the one end and the other end of the housing, respectively.

3. The motion pillow of claim 1, wherein each of the first vibration-proof material and the second vibration-proof material comprises:

an outer structure having a shape corresponding to an inner space of the housing;

an inner structure provided in the outer structure;

an outer piece provided to fill a space between the outer structure and the inner structure; and an inner piece provided to fill an inner space of the inner structure.

4. The motion pillow of claim 3, wherein the inner structure comprises:

a first inner structure spaced apart from the outer structure inside the outer structure and provided in a longitudinal direction of the housing; and second inner structures spaced by a predetermined gap from each other on an outer surface of the first inner structure and configured to connect the first inner structure and the outer structure.

5. The motion pillow of claim 4, wherein the outer piece is filled in each of spaces divided by the second inner structure inside the outer structure, and each of the first vibration-proof material and the second vibration-proof material further comprises at least one through-hole formed in a thickness direction of the outer piece.

6. The motion pillow of claim 4, wherein the inner piece is filled in the inner space of the first inner structure, and each of the first vibration-proof material and the second vibration-proof material further comprises at least one through-hole formed in a thickness direction of the inner piece.

7. The motion pillow of claim 1, wherein the housing has a cross-section along a longitudinal direction of the housing and is distinguished into a first housing and a second housing based on the cross-section.

8. The motion pillow of claim 7, wherein the first housing and the second housing are bonded to each other at the cross-section and sealed through taping performed on an outer surface of the housing.

9. The motion pillow of claim 1, wherein the inner cover comprises a through-hole into which the air hose is inserted, and the motion pillow comprises:

a first pocket provided on the inner cover, provided at one side of the through-hole based on the through-hole based on the through-hole, and extending in one direction in a state in which the air hose is bent; and a second pocket provided on the inner cover, provided at the other side of the through-hole based on the through-hole, and extending in the other direction in the state in which the air hose is bent.

10. The motion pillow of claim 9, wherein in each of the first pocket and the second pocket, an upper end and a lower end are connected to the inner cover, and both sides are opened so that the air hose passes therethrough.

11. The motion pillow of claim 1, wherein the motion pillow further comprises:

a memory foam provided on the air bag inside the inner cover; and a height adjustment pad provided on at least one of the inside of the inner cover and a portion between the inner cover and the outer cover.

* * * * *